US009875691B2

(12) United States Patent
Wang et al.

(10) Patent No.: US 9,875,691 B2
(45) Date of Patent: Jan. 23, 2018

(54) PIXEL CIRCUIT, DRIVING METHOD THEREOF AND DISPLAY DEVICE

(71) Applicants: BOE TECHNOLOGY GROUP CO., LTD., Beijing (CN); ORDOS YUANSHENG OPTOELECTRONICS CO., LTD., Ordos, Inner Mongolia (CN)

(72) Inventors: Bo Wang, Beijing (CN); Minghua Xuan, Beijing (CN); Yi Zhang, Beijing (CN)

(73) Assignees: BOE TECHNOLOGY GROUP CO., LTD., Beijing (CN); ORDOS YUANSHENG OPTOELECTRONICS CO., LTD., Ordos, Inner Mongolia (CN)

( * ) Notice: Subject to any disclaimer, the term of this patent is extended or adjusted under 35 U.S.C. 154(b) by 59 days.

(21) Appl. No.: 14/909,943

(22) PCT Filed: Aug. 20, 2015

(86) PCT No.: PCT/CN2015/087632

§ 371 (c)(1),
(2) Date: Feb. 3, 2016

(87) PCT Pub. No.: WO2016/141681

PCT Pub. Date: Sep. 15, 2016

(65) Prior Publication Data

US 2017/0039945 A1 Feb. 9, 2017

(30) Foreign Application Priority Data

Mar. 6, 2015 (CN) ..... 2015 1 0101471

(51) Int. Cl.
*G09G 3/30* (2006.01)
*G09G 3/3258* (2016.01)
(Continued)

(52) U.S. Cl.
CPC ..... *G09G 3/3258* (2013.01); *G09G 3/3233* (2013.01); *G09G 3/3291* (2013.01);
(Continued)

(58) Field of Classification Search
CPC ..... G09G 3/3258; G09G 3/3291; G09G 2310/08; G09G 2300/043; G09G 2320/045; G09G 2300/0809
(Continued)

(56) References Cited

U.S. PATENT DOCUMENTS

2012/0162275 A1* 6/2012 Park ..... H01L 27/3265 345/690
2013/0249889 A1 9/2013 Han et al.
(Continued)

FOREIGN PATENT DOCUMENTS

CN 1741109 A 3/2006
CN 101266757 A 9/2008
(Continued)

OTHER PUBLICATIONS

First Office Action dated Aug. 3, 2016 corresponding to Chinese application No. 201510101471.6.
(Continued)

*Primary Examiner* — Jennifer Nguyen
(74) *Attorney, Agent, or Firm* — Nath, Goldberg & Meyer; Joshua B. Goldberg; Annie Kock

(57) ABSTRACT

The present invention provides a pixel circuit, a driving method thereof and a display device. The pixel circuit comprises a drive module, an energy storage module, an electroluminescent module, a data voltage writing module, a threshold compensation module and a reset module, and also comprises an operating voltage input terminal, a data voltage input terminal and a plurality of control signal input terminal. The threshold compensation module is capable of introducing the voltage on the compensation voltage input terminal so as to set the voltage on the control terminal of the drive module to be a sum of the threshold voltage of the drive module and the operating voltage, thus the driving
(Continued)

current flowing through the electroluminescent units is not affected by the threshold voltage of corresponding drive modules, such that the problem of uneven display brightness caused by the threshold voltage drift of driving transistors can be solved.

20 Claims, 6 Drawing Sheets

(51) Int. Cl.
*G09G 3/3291* (2016.01)
*G09G 3/3233* (2016.01)

(52) U.S. Cl.
CPC ..... *G09G 2300/043* (2013.01); *G09G 2300/0809* (2013.01); *G09G 2300/0819* (2013.01); *G09G 2300/0842* (2013.01); *G09G 2300/0861* (2013.01); *G09G 2310/08* (2013.01); *G09G 2320/045* (2013.01)

(58) Field of Classification Search
USPC ..... 345/76, 211–213, 690, 78
See application file for complete search history.

(56) References Cited

U.S. PATENT DOCUMENTS

| | | | | |
|---|---|---|---|---|
| 2016/0125808 | A1* | 5/2016 | Hsu | G09G 3/3233 345/212 |
| 2016/0148566 | A1* | 5/2016 | Tseng | G09G 3/3233 345/212 |

FOREIGN PATENT DOCUMENTS

| | | | |
|---|---|---|---|
| CN | 102930824 | A | 2/2013 |
| CN | 103971640 | A | 8/2014 |
| CN | 203882587 | U | 10/2014 |
| CN | 104217682 | A | 12/2014 |
| CN | 104658480 | A | 5/2015 |
| KR | 20100045578 | A | 5/2010 |
| KR | 20120043301 | A | 5/2012 |
| TW | 594638 | B | 6/2004 |

OTHER PUBLICATIONS

ISR issued in international application No. PCT/CN2015/087632 dated Nov. 24, 2015.

* cited by examiner

PIXEL CIRCUIT, DRIVING METHOD THEREOF AND DISPLAY DEVICE

This is a National Phase Application filed under 35 U.S.C. 371 as a national stage of PCT/CN2015/087632, filed Aug. 20, 2015, an application claiming the benefit of Chinese Application No. 201510101471.6, filed Mar. 6, 2015, the content of each of which is hereby incorporated by reference in its entirety.

FIELD OF THE INVENTION

The present invention relates to the field of display technology, and more particularly to a pixel circuit, a driving method thereof and a display device.

BACKGROUND OF THE INVENTION

Organic Light Emitting Diode (OLED) has become a popular field in the flat panel display researching. As a current-controlled light-emitting device. OLED has being increasingly applied in the field of high-performance display, due to the characteristics such as self-emission, fast response, wide viewing angle and capable of being fabricated on flexible substrate. Currently, in the display field of phone, PDA, digital cameras and the like, OLED has begun to replace the traditional LCD (Liquid Crystal Display) display. Pixel driving circuit design is a key technical content of OLED display, which has important significance of research. Different from TFT (Thin Film Transistor)-LCD which controls brightness by using stable voltage, OLED is of a current driving type which requires stable current to control light emitting. Due to process technology, device aging and other reasons, in an original 2T1C driving circuit (including two thin-film transistors and a capacitor), the threshold voltage on the driving TFTs of the respective pixels is uneven, thereby the current flowing through the OLED in each pixel is varied, the display brightness is uneven, thus affecting the display performance of the entire image.

SUMMARY OF THE INVENTION

An object of the present invention is to provide a pixel circuit which is able to avoid the uneven display brightness caused by threshold drift.

As a first aspect, there is provided a pixel circuit comprising: a drive module, an energy storage module, an electroluminescent module, a data voltage writing module, a threshold compensation module and a reset module, and further comprising an operating voltage input terminal, a data voltage input terminal and a plurality of control signal input terminals; wherein a first terminal of the energy storage module is connected to a first node, a second terminal of the energy storage module is connected to a second node;

a control terminal of the drive module is connected to the first node, an output terminal of the drive module is connected to a third node, the drive module is configured to generate, when a first terminal of the drive module is connected to the operating voltage input terminal, a drive current for driving the electroluminescent module according to the voltage on the first node, and output the drive current to the third node;

the data voltage writing module is connected to a first control signal input terminal, the data voltage input terminal and the second node, the data voltage writing module is configured to write the data voltage applied to the data voltage input terminal to the second node in response to the control signal applied to the first control signal input terminal;

the threshold compensation module is connected to the first node and a second control signal input terminal, the threshold compensation module is configured to compensate the voltage on the first node into a sum of the threshold voltage of the drive module and the voltage applied to the operating voltage input terminal in response to the control signal applied to the second control signal input terminal;

an output terminal of the reset module is connected to the first node, an input terminal and a control terminal of the reset module are connected to a third control signal input terminal, the reset module is configured to be turned on when a reset pulse is applied to the third control signal input terminal, so as to reset the first node.

Further, the reset module comprises a first controlled switch unit, a control terminal and a first terminal of the first controlled switch unit are connected to the third control signal input terminal, a second terminal of the first controlled switch unit is connected to the first node, the threshold voltage thereof is consistent with the level of the reset pulse.

Further, the threshold compensation module comprises a second controlled switch unit, a first terminal of the second controlled switch unit is connected to the third node, a second terminal of the second controlled switch unit is connected to the first node, and a control terminal of the second controlled switch unit is connected to the second control signal input terminal.

Further, the data voltage writing module comprises a third controlled switch unit, a first terminal of the third controlled switch unit is connected to the data voltage input terminal, a second terminal of the third controlled switch unit is connected to the second node, and a control terminal of the third controlled switch unit is connected to the first control signal input terminal.

Further, the first and second control signal input terminals are a same input terminal;

the threshold voltage of the third controlled switch unit is consistent with that of the second controlled switch unit.

Further, the data voltage writing module comprises a fourth controlled switch unit, a first terminal of the fourth controlled switch unit is connected to the data voltage input terminal, a second terminal of the fourth controlled switch unit is connected to the second node.

Further, a control terminal of the fourth controlled switch unit is connected to the third control signal input terminal, and the threshold voltage of the fourth controlled switch unit is consistent with that of the first controlled switch unit.

Further, the data voltage writing module comprises a fifth controlled switch unit, a first terminal of the fifth controlled switch unit is connected to the operating voltage input terminal, a second terminal of the fifth controlled switch unit is connected to the second node, and a control terminal of the fifth controlled switch unit is connected to a fourth control signal input terminal.

Further, the pixel circuit comprises a sixth controlled switch unit, a first terminal of the sixth controlled switch unit is connected to the third node, a second terminal of the sixth controlled switch unit is connected to the electroluminescent module.

Further, a control terminal of the sixth controlled switch unit is connected to the fourth control signal input terminal, and the threshold voltage of the sixth controlled switch unit is consistent with that of the fifth controlled switch unit.

Further, each of the controlled switch units and the drive module is a P-type transistor.

As a second aspect, the present invention provides a driving method for any one of above pixel circuits, wherein the driving method comprises: a reset phase, a compensation phase, a data voltage writing phase and a light emitting phase; wherein, in the reset phase, a reset pulse is applied to the third control signal input terminal, the voltage on the first node is reset to the voltage corresponding to the reset pulse;

in the compensation phase, the threshold compensation module is controlled by a control signal applied to the second control signal input terminal, so as to compensate the voltage on the first node to a sum of the threshold voltage of the drive module and the voltage applied to the operating voltage input terminal;

in the data voltage writing phase, a control signal is applied to the first control signal input terminal to turn on the data voltage writing module, so as to write the voltage on the data voltage input terminal to the second node;

in the light emitting phase, the voltage on the first node is transited by changing the voltage on the second node, so that the drive control module generates a driving current for driving the electroluminescent module to emit light.

As a third aspect, the present invention also provides a display device comprising any one of above pixel circuits.

The pixel circuit provided by the present invention comprises the threshold compensation module which is capable of introducing the voltage on the compensation voltage input terminal so as to set the voltage on the control terminal of the drive module to be a sum of the threshold voltage of the drive module and the operating voltage, thus in the subsequent light emission procedure, the threshold voltage component included in the voltage on the control terminal of the drive module is canceled by the threshold voltage of the drive module, therefore the driving current flowing through the electroluminescent units is not affected by the threshold voltage of corresponding drive modules, such that the problem of uneven display brightness caused by the threshold voltage drift of driving transistors can be solved.

DETAILED DESCRIPTION OF THE EMBODIMENTS

In order to render the object, solutions and advantages of the present invention more clearly, the technical solutions of the embodiments of the present invention will be described clearly and thoroughly in conjunction with the accompanying drawings.

Apparently, the described embodiments are merely a part, rather than all of the embodiments of the present invention. Based on the embodiments of the present invention, other embodiments can be obtained by those skilled in the art without creative work, and these embodiments also falls within the scope of the present invention.

Figure 1:
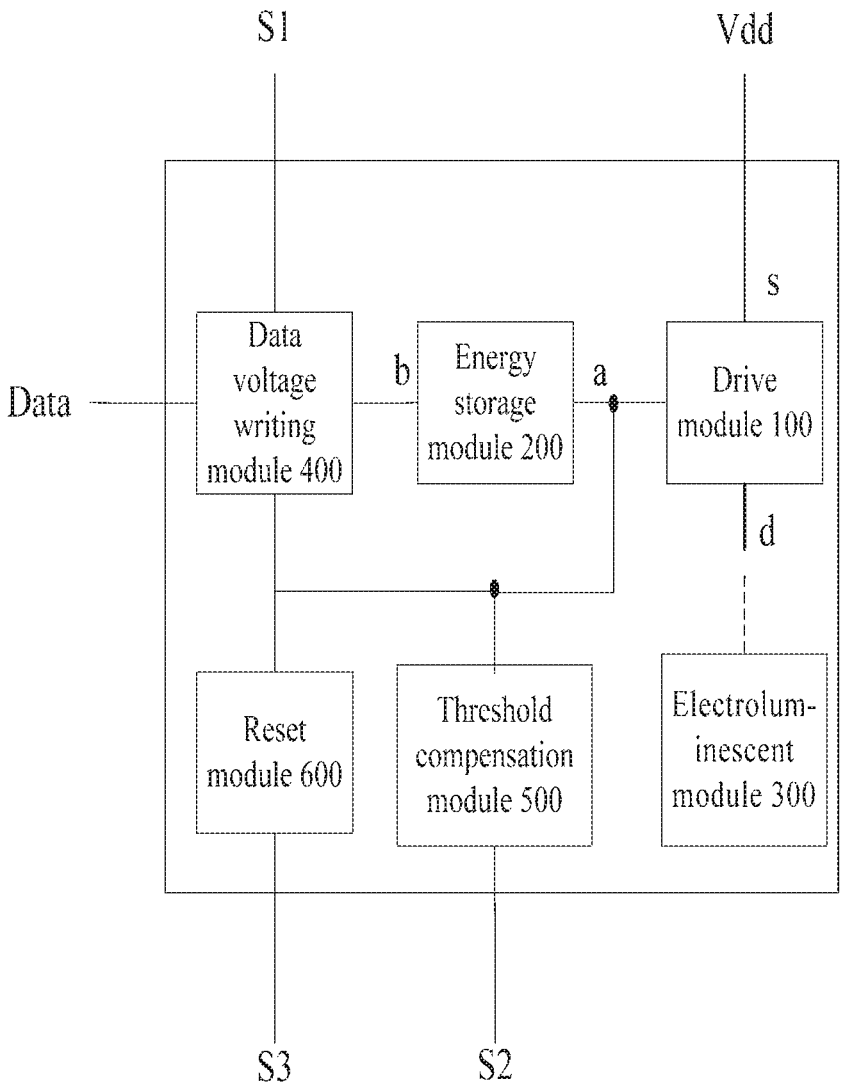
FIG. 1 is a schematic structural view of the pixel circuit according to an embodiment of the present invention.

According to an embodiment of the present invention, as shown in FIG. 1, there is provided a pixel circuit comprising: a drive module 100, an energy storage module 200, an electroluminescent module 300, a data voltage writing module 400, a threshold compensation module 500 and a reset module 600, and further comprising an operating voltage input terminal Vdd, a data voltage input terminal Data, a first control signal input terminal S1, a second control signal input terminal S2 and a third control signal input terminal S3; wherein the first terminal of the energy storage module 200 is connected to a first node a, a second terminal of the energy storage module 200 is connected to a second node b;

a control terminal of the drive module 100 is connected to the first node a, an output terminal of the drive module 100 is connected to a third node d, an input terminal of the drive module 100 is connected to a fourth node s, the drive module 100 is configured to generate, when the fourth node s is connected to the operating voltage input terminal Vdd, a drive current for driving the electroluminescent module 300 to emit light according to the voltage on the first node a, and output the drive current to the third node d;

the data voltage writing module 400 is connected to a first control signal input terminal S1, the data voltage input terminal Data and the second node b, the data voltage writing module 400 is configured to write the data voltage applied to the data voltage input terminal Data to the second node b in response to the control signal applied to the first control signal input terminal S1;

the threshold compensation module 500 is connected to the first node a and a second control signal input terminal S2, the threshold compensation module 500 is configured to compensate the voltage on the first node a into a sum of the threshold voltage Vth of the drive module 100 and the voltage applied to the operating voltage input terminal Vdd in response to the control signal applied to the second control signal input terminal S2;

an output terminal of the reset module 600 is connected to the first node a, an input terminal and a control terminal of the reset module 600 are connected to a third control signal input terminal S3, the reset module 600 is configured to be turned on when a reset pulse is applied to the third control signal input terminal S3, so as to reset the first node a.

The pixel circuit provided by the present invention comprises the threshold compensation module which is capable of introducing the voltage on the compensation voltage input terminal so as to set the voltage on the control terminal of the drive module to be a sum of the threshold voltage of the drive module and the operating voltage, thus in the subsequent light emission procedure, the threshold voltage component included in the voltage on the control terminal of the drive module is canceled by the threshold voltage of the drive module, therefore the driving current flowing through the electroluminescent units is not affected by the threshold voltage of corresponding drive modules, such that the problem of uneven display brightness caused by the threshold voltage drift of driving transistors can be solved. In the embodiments of the present invention, the input terminal and the control terminal of the reset module are both connected to the third control signal input terminal. The reset module is configured to be turned on when the reset pulse is applied to the third control signal input terminal so as to reset the first node a, thus in practical application, the first node can be reset by using a single signal line to connect the input terminal and the control terminal of the reset module, a signal line can be saved, the occupied area of the pixel circuit can be reduced and the resolution of the display device can be increased.

In a specific embodiment, the reset module 600 may include a first controlled switch unit T1, a control terminal and a first terminal of the first controlled switch unit T1 are connected to the third control signal input terminal S3, a second terminal of the first controlled switch unit T1 is connected to the first node a, the threshold voltage of the first controlled switch unit T1 is consistent with the level of the reset pulse.

In a specific embodiment, the threshold compensation module 500 may comprise a second controlled switch unit T2, a first terminal of the second controlled switch unit T2 is connected to the third node d, a second terminal of the second controlled switch unit T2 is connected to the first node a, and a control terminal of the second controlled switch unit T2 is connected to the second control signal input terminal S2.

Figure 2:
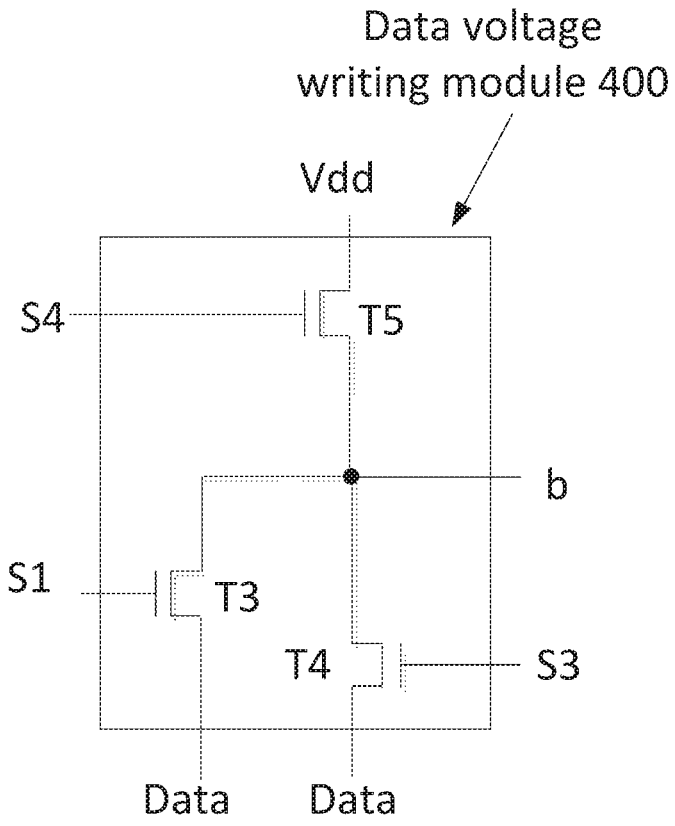
FIG. 2 is a schematic view of a possible circuit of the data voltage writing module 400 in FIG. 1.

In a specific embodiment, as shown in FIG. 2, the data voltage writing module 400 may comprise a third controlled switch unit T3, a first terminal of the third controlled switch unit T3 is connected to the data voltage input terminal Data, a second terminal of the third controlled switch unit T3 is connected to the second node b, and a control terminal of the third controlled switch unit T3 is connected to the first control signal input terminal S1.

In a specific embodiment, the threshold voltage of the third controlled switch unit T3 herein is consistent with that of the second controlled switch unit T2, the first and second control signal input terminals S1/S2 may be a same input terminal.

Here, the representation that the threshold voltages are consistent refers to that, when the threshold voltage of the third controlled switch unit T3 is at high level, the threshold voltage of the second controlled switch unit T2 is also at high level. Also, when the threshold voltage of the third controlled switch unit T3 is at low level, the threshold voltage of the second controlled switch unit T2 is also at low level.

Since the second controlled switch unit T2 and the third controlled switch unit T3 are connected by a same control signal input terminal, the second controlled switch unit T2 and the third controlled switch unit T3 can be controlled by the single signal line to be turned on and off, thereby the signal lines can be reduced. Alternatively, in practical application, the second controlled switch unit T2 and the third controlled switch unit T3 can be connected to different control signal lines, and the threshold voltages of the second controlled switch unit T2 and the third controlled switch unit T3 may be inconsistent with each other.

In a specific embodiment, as shown in FIG. 2, the data voltage writing module 400 further comprises a fourth controlled switch unit T4, a first terminal of the fourth controlled switch unit T4 is connected to the data voltage input terminal Data, a second terminal of the fourth controlled switch unit T4 is connected to the second node b.

By providing the fourth controlled switch unit T4, before the data voltage is written, a reset voltage is input from the data voltage input terminal Data, the fourth controlled switch unit T4 is turned on, so that the second node b is reset. Of course, in practice the second node b may be reset by other configuration.

In a specific embodiment, a control terminal of the fourth controlled switch unit T4 is connected to the third control signal input terminal S3, and the threshold voltage of the fourth controlled switch unit T4 is consistent with that of the first controlled switch unit T1. Thus the number of signal lines can be reduced. Of course, in practice the control terminal of the fourth controlled switch unit T4 can be connected to an individual control signal input terminal.

In a specific embodiment, as shown in FIG. 2, the data voltage writing module 400 may further comprise a fifth controlled switch unit T5, a first terminal of the fifth controlled switch unit T5 is connected to the operating voltage input terminal Vdd, a second terminal of the fifth controlled switch unit T5 is connected to the second node b, and a control terminal of the fifth controlled switch unit T5 is connected to a fourth control signal input terminal S4.

It is readily understood that in practical application, the fourth controlled switch unit T4 and the fifth controlled switch unit T5 mentioned above are not necessarily provided. By applying proper control signals to the first control signal input terminal S1 and the data voltage input terminal Data, the second terminal of the energy storage module 200 can also be reset and the data voltage can be written. The configuration shown in FIG. 2 shall not be construed as limitation to the protective scope of the present invention.

In a specific embodiment, the pixel circuit further comprises a sixth controlled switch unit T6 (not shown), a first terminal of the sixth controlled switch unit T6 is connected to the third node d, a second terminal of the sixth controlled switch unit T6 is connected to the electroluminescent module 300.

Further, in a specific embodiment, a control terminal of the sixth controlled switch unit T6 is connected to the fourth control signal input terminal S4, and the threshold voltage of the sixth controlled switch unit T6 is consistent with that of the fifth controlled switch unit T5.

In a specific embodiment, each of the controlled switch units and the drive module 100 may be a P-type transistor, resulting in an advantage of reduced complexity for fabricating display devices by using unified process. Of course, in practice a part or all of the controlled switch units can be replaced with N-type transistors. The corresponding solutions can also solve the problems to be solved by the present invention, and therefore fall within the protective scope of the present invention.

In a specific embodiment, the energy storage module 200 may include a capacitor. Of course, in practical applications, other elements having storage capabilities can be adopted depending on design requirements.

In a specific embodiment, the electroluminescent module 300 may comprise an organic electroluminescent element OLED, an anode of the organic electroluminescent element OLED is connected to the fourth controlled switch unit, and a cathode thereof is connected to the low voltage terminal.

On the other hand, the present invention also provides a driving method for driving the above pixel circuits. The driving method comprises: a reset phase, a compensation phase, a data voltage writing phase and a light emitting phase; wherein, in the reset phase, a reset pulse is applied to the third control signal input terminal, the voltage on the first node is reset to the voltage corresponding to the reset pulse;

in the compensation phase, the threshold compensation module is controlled by a control signal applied to the second control signal input terminal, so as to compensate the voltage on the first node to a sum of the threshold voltage of the drive module and the voltage applied to the operating voltage input terminal;

in the data voltage writing phase, a control signal is applied to the first control signal input terminal to turn on the data voltage writing module, so as to write the voltage on the data voltage input terminal to the second node;

in the light emitting phase, the voltage on the first node is transited by changing the voltage on the second node, so that the drive control module generates a driving current for driving the electroluminescent module to emit light.

By using the driving method of the present invention, the driving current flowing through the electroluminescent units is not affected by the threshold voltage of corresponding drive modules, such that the problem of uneven display brightness caused by threshold voltage drift of driving transistors can be solved.

In specific embodiment, different pixel circuit structures require different control sequence for the light emitting phase. For example, when the pixel circuit comprises the fifth controlled switch unit T5 and the sixth controlled switch unit T6 as above, the fifth controlled switch unit T5 and the sixth controlled switch unit T6 shall be turned on to adjust the voltage on the second node, so that voltage on the first node transits to keep the drive module being turned on. On the other hand, the current generated by the drive module flows through the sixth controlled switch unit T6 to the electroluminescent unit. When the pixel circuit does not comprise the fifth controlled switch unit T5, in the light emitting phase, the third controlled switch unit T3 can be kept being turned on, and different data voltage is applied to the data voltage input terminal Data, so as to adjust the voltage on the second node to make the voltage on the first node transits, so that the drive module is kept being turned on.

In specific embodiment, the compensation phase and the data voltage writing phase may be a same phase, that is, the procedures of threshold compensation and data voltage writing can be performed in parallel.

Figure 3:
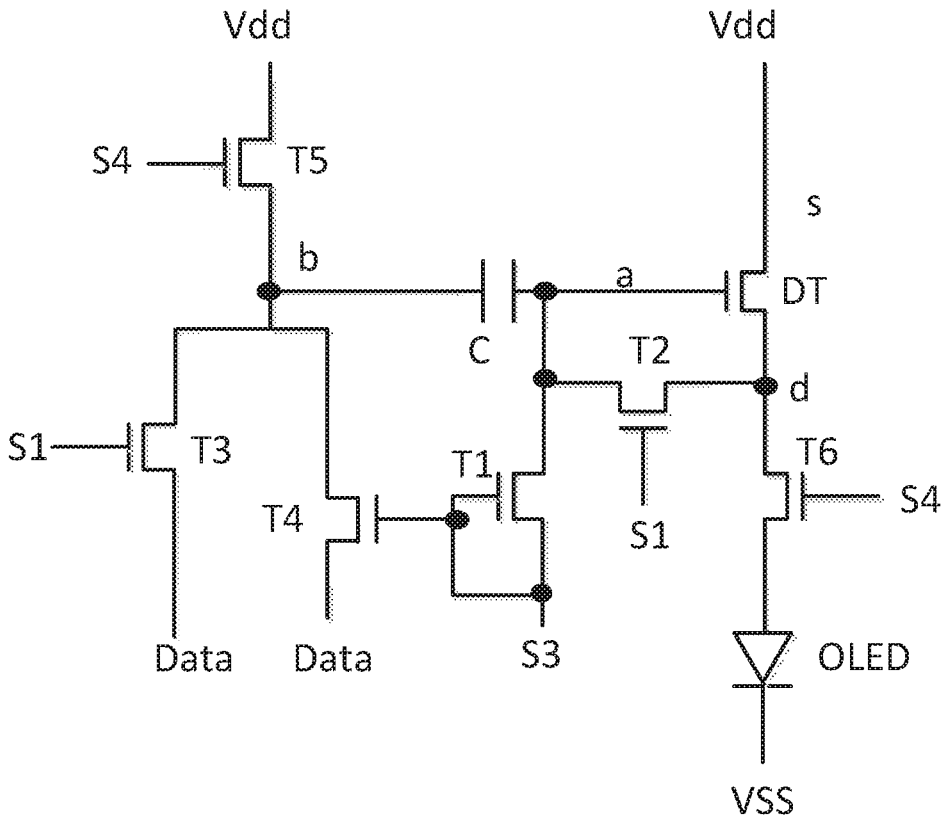
FIG. 3 is a configuration diagram of the pixel circuit according to an embodiment of the present invention.

In the following, a driving method for the pixel circuit and the operating principle thereof provided by an embodiment of the present invention will be described with reference to a specific circuit structure. FIG. 3 shows a schematic view of a possible pixel circuit, the pixel circuit comprises six P-type switching transistors T1-T6, a P-type drive transistor DT, an electroluminescent element OLED and a capacitor C, wherein the switching transistor T1 forms the reset module, the switching transistor T2 forms the threshold compensation module, the switching transistors T3, T4 and T5 form the data voltage writing module, the capacitor C forms the energy storage module, the drive transistor DT forms the drive module. The pixel circuit also has an operating voltage input terminal Vdd, a data voltage input terminal Data, and control signal input terminals S1, S3, S4; wherein the capacitor C has one terminal connected to the first node a, the other terminal connected to the second node b; a source electrode of the drive transistor DT is connected to the fourth node s, the drain electrode of the drive transistor DT is connected to the third node d; the drain electrodes of the switching transistors T1, T2 are both connected to the first node a, the gate and source of the switching transistor T1 are both connected to the third control signal input terminal S3; the source of the switching transistor T2 is connected to the third node d, the gate of the switching transistor T2 is connected to the first control signal input terminal S1; the drain electrodes of the switching transistors T3, T4 and T5 are connected to the second node b; the source electrodes of the switching transistors T3, T4 are both connected to the data voltage input terminal Vdata; the gate of the switching transistor T3 is connected to the first control signal input terminal S1, the gate of the switching transistor T4 is connected to the third control signal input terminal S3; the gates of the switching transistors T5, T6 are both connected to the fourth control signal input terminal S4, the source of the switching transistor T5 is connected to the operating voltage input terminal Vdd; the source of the switching transistor T6 is connected to the third node d, the drain of the switching transistor T6 is connected to the anode electrode of the electroluminescent element OLED; the cathode electrode of the electroluminescent element OLED is connected to the low voltage terminal VSS.

Figure 4:
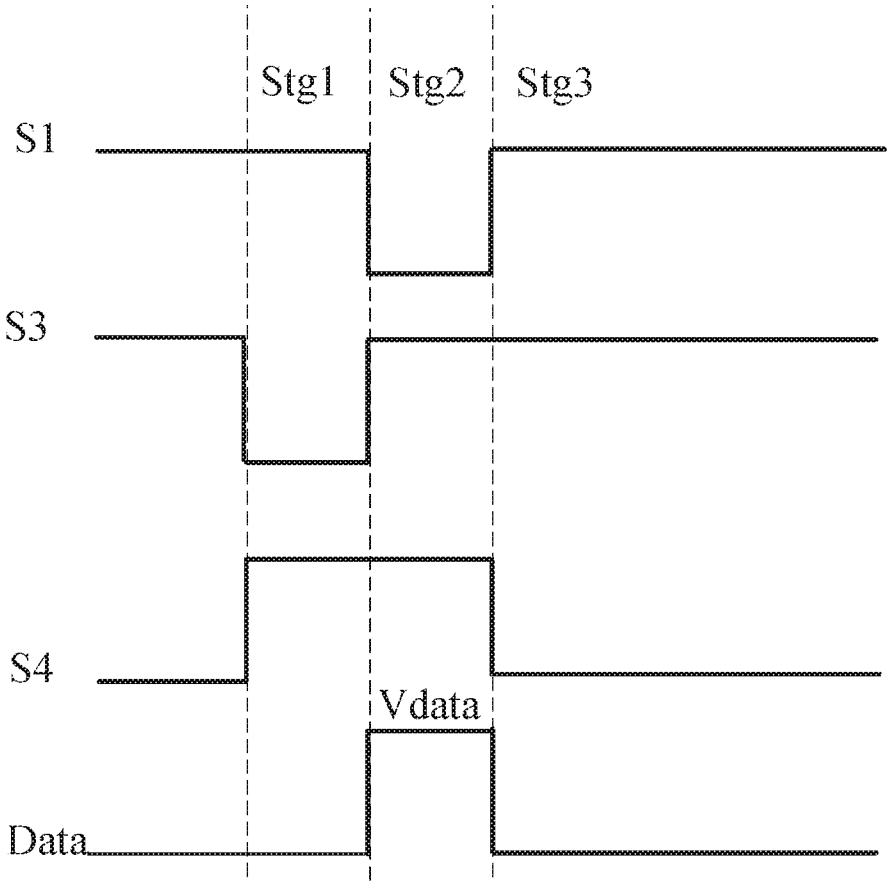
FIG. 4 is a timing sequence diagram of the key input signals in the driving method for the pixel circuit shown in FIG. 3.

FIG. 4 is a timing sequence diagram of the key signals in the driving method for the pixel circuit shown in FIG. 3. The driving method comprises following phases.

Figure 5A:
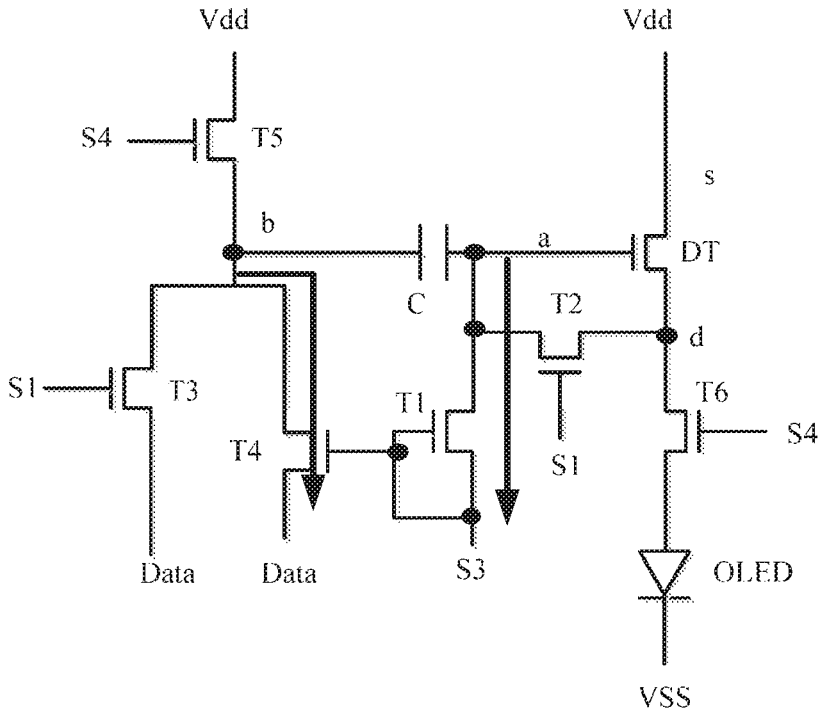
FIG. 5*a*-FIG. 5*c* are schematic diagrams showing the current directions and voltage values on the key nodes of the pixel circuit shown in FIG. 3 in different timing sequences.

In the reset phase Stg1, a reset pulse (low level) is applied to the control signal input terminal S3, the switching transistors T1, T4 are turned on, a high level is applied to other control signal input terminals to turn off the other switching transistors, and a reset voltage (it is assumed to be zero) is applied to the data voltage input terminal Data. At this time, as shown in FIG. 5*a*, the first terminal of the capacitor C is discharged via the switching transistor T1, the second terminal of the capacitor C is discharged via the switching transistors T1 and T4, the voltage on the first node a connected to the first terminal of the capacitor C is pulled down, and the voltage on the second node b connected to the second terminal of the capacitor C is reset.

Figure 5B:
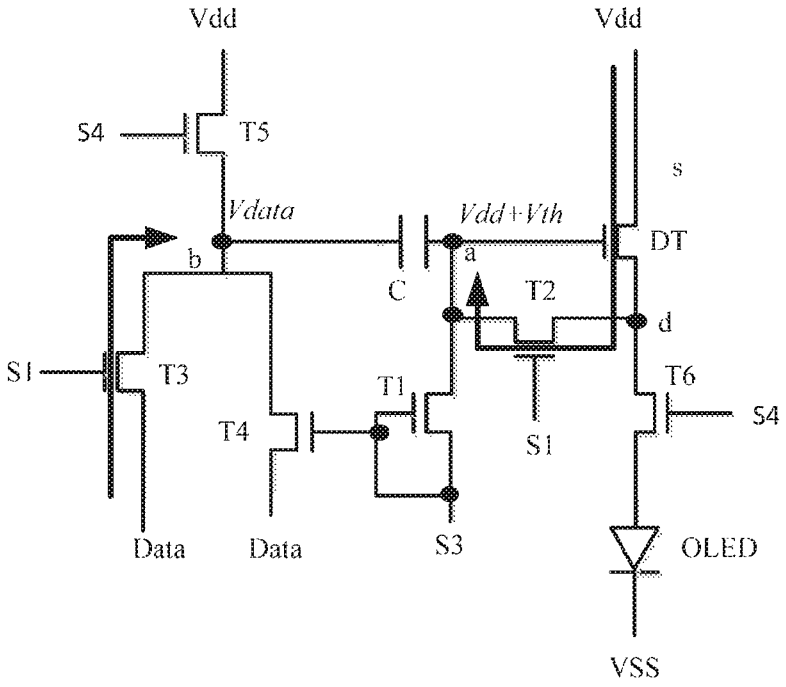

In the compensation and data voltage writing phase Stg2, a low level is applied to the control signal input terminal S1, the switching transistors T2, T3 are turned on, and a high level is applied to other control signal input terminals to turn off the other switching transistors, and the data voltage Vdata is applied to the data voltage input terminal (the drawing shows a case where the data voltage is a positive voltage, while in practice, the data voltage herein may also be a negative voltage as needed, the detailed description thereof is omitted here). As shown in FIG. 5*b*, the operating voltage input terminal Vdd charges the first node a via the drive transistor DT and the switching transistor T2, until the voltage on the first node a reaches Vdd+Vth (at this time the cut-off condition of the drive transistor DT is reached, Vth is the threshold voltage of the drive transistor DI which is a negative value). In this phase, since the switching transistor T6 is turned off, the electroluminescent element OLED does not emit light, thereby the lifetime of the electroluminescent element OLED is elongated. The switching transistor T3 is turned on and the data voltage Vdata is written to the second node b. The voltage difference between the first node a and the second node b is Vdd+Vth−Vdata.

Figure 5C:
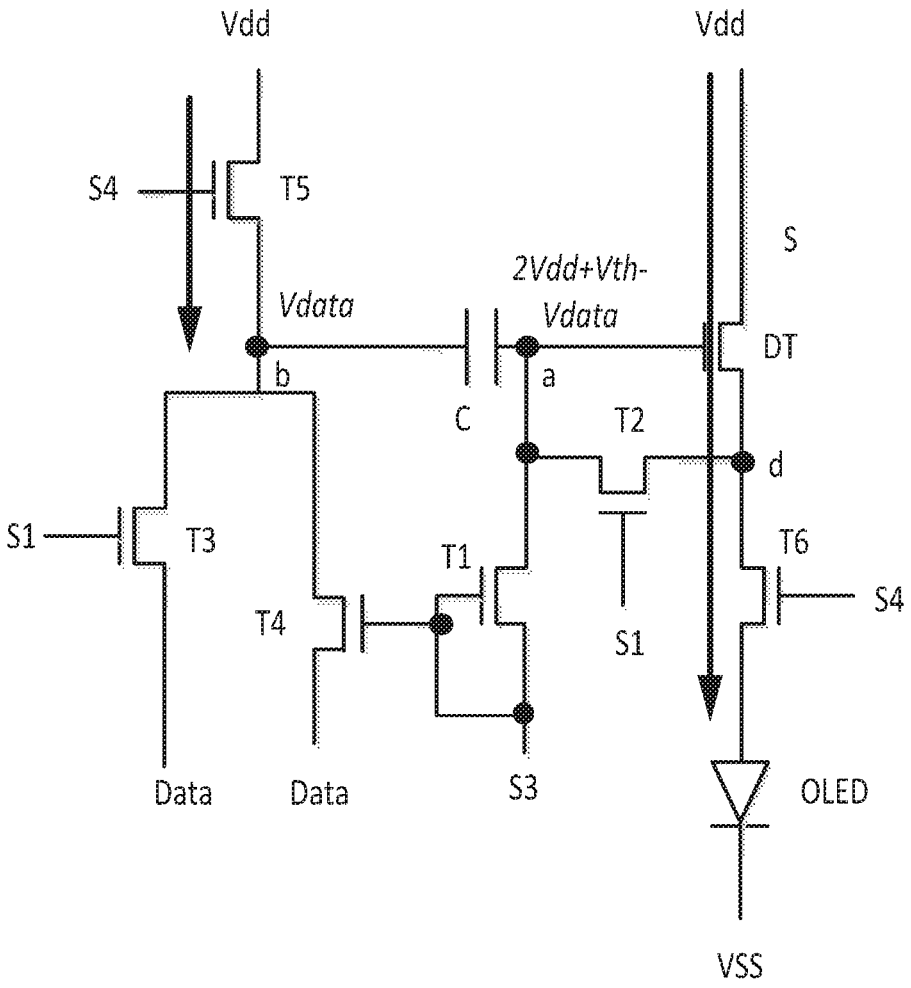

In the light emitting phase, a low level is applied to the control signal input terminal S4, and a high level is applied to other control signal input terminals, thus the switching transistors T5, T6 are turned on and the other switching transistors are turned off. As shown in FIG. 5*c*, the operating voltage input terminal Vdd is connected to the second node b via the switching transistor T5. The voltage on the second node is set to be Vdd, since the first node a is floated, the voltage on the first node a transits to be 2Vdd+Vth−Vdata (the voltage difference across the capacitor C is kept as Vdd+Vth−Vdata). Since the switching transistor T6 is turned on, the operating voltage input terminal Vdd supplies current to the electroluminescent element OLED via the drive transistor DT and the switching transistor T6, driving the electroluminescent element OLED to emit light.

Since the gate voltage of the drive transistor DT is 2Vdd+Vth−Vdata, it can be obtained according to the saturation current formula of TFT:

$$I_{OLED} = K(2Vdd + Vth - Vdata - Vdd - Vth)^2$$
$$= K(2Vdd + Vth - Vdata - Vdd - Vth)^2$$
$$= K(Vdd - Vdata)^2$$

From above formula, it can be seen that the operating current is not affected by the threshold voltage Vth of the drive transistors, but only related to the data voltage Vdata. Therefore the threshold voltage drift problem of the drive transistor DT due to fabricating process and long term operating can be solved completely, the operating current $I_{OLED}$ is not affected and the electroluminescent element OLED is ensured to operate normally.

The present invention also provides a display device comprising any one of above pixel circuits.

The display device described herein may be: electronic paper, mobile phone, tablet computer, television, monitor, notebook computer, digital picture frame, navigation system and any other product or component having a display function.

The foregoing embodiments are only specific embodiments of the present invention, the protective scope of the present invention is not limited thereto. Various variations or replacements that are apparent to those skilled in the art should fall within the scope of the present invention. Accordingly, the scope of the present invention should be defined by the claims.

The invention claimed is:

1. A pixel circuit, comprising: a drive module, an energy storage module, an electroluminescent module, a data voltage writing module, a threshold compensation module and a reset module, and further comprising an operating voltage input terminal, a data voltage input terminal and a plurality of control signal input terminals; wherein a first terminal of the energy storage module is connected to a first node, a second terminal of the energy storage module is connected to a second node;

a control terminal of the drive module is connected to the first node, an output terminal of the drive module is connected to a third node, the drive module is configured to generate, when a first terminal of the drive module is connected to the operating voltage input terminal, a drive current for driving the electroluminescent module according to the voltage on the first node, and output the drive current to the third node;

the data voltage writing module is connected to a first control signal input terminal, the data voltage input terminal and the second node, the data voltage writing module is configured to write the data voltage applied to the data voltage input terminal to the second node in response to the control signal applied to the first control signal input terminal;

the threshold compensation module is connected to the first node and a second control signal input terminal, the threshold compensation module is configured to compensate the voltage on the first node into a sum of the threshold voltage of the drive module and the voltage applied to the operating voltage input terminal in response to the control signal applied to the second control signal input terminal; and an output terminal of the reset module is directly connected to the first node, an input terminal and a control terminal of the reset module are connected to a third control signal input terminal, the reset module is configured to be turned on when a reset pulse is applied to the third control signal input terminal, so as to reset the first node.

2. The pixel circuit according to claim 1, wherein the reset module comprises a first controlled switch unit, a control terminal and a first terminal of the first controlled switch unit are connected to the third control signal input terminal, a second terminal of the first controlled switch unit is connected to the first node, the threshold voltage of the first controlled switch unit is consistent with the level of the reset pulse.

3. The pixel circuit according to claim 2, wherein each of the controlled switch units and the drive module is a P-type transistor.

4. The pixel circuit according to claim 1, wherein the threshold compensation module comprises a second controlled switch unit, a first terminal of the second controlled switch unit is connected to the third node, a second terminal of the second controlled switch unit is connected to the first node, and a control terminal of the second controlled switch unit is connected to the second control signal input terminal.

5. The pixel circuit according to claim 4, wherein each of the controlled switch units and the drive module is a P-type transistor.

6. The pixel circuit according to claim 1, wherein the data voltage writing module comprises a third controlled switch unit, a first terminal of the third controlled switch unit is connected to the data voltage input terminal, a second terminal of the third controlled switch unit is connected to the second node, and a control terminal of the third controlled switch unit is connected to the first control signal input terminal.

7. The pixel circuit according to claim 6, wherein the first and second control signal input terminals are a same input terminal; the threshold voltage of the third controlled switch unit is consistent with that of the second controlled switch unit.

8. The pixel circuit according to claim 7, wherein the data voltage writing module comprises a fourth controlled switch unit, a first terminal of the fourth controlled switch unit is connected to the data voltage input terminal, a second terminal of the fourth controlled switch unit is connected to the second node.

9. The pixel circuit according to claim 8, wherein a control terminal of the fourth controlled switch unit is connected to the third control signal input terminal, and the threshold voltage of the fourth controlled switch unit is consistent with that of the first controlled switch unit.

10. The pixel circuit according to claim 9, wherein each of the controlled switch units and the drive module is a P-type transistor.

11. The pixel circuit according to claim 8, wherein the data voltage writing module comprises a fifth controlled switch unit, a first terminal of the fifth controlled switch unit is connected to the operating voltage input terminal, a second terminal of the fifth controlled switch unit is connected to the second node, and a control terminal of the fifth controlled switch unit is connected to a fourth control signal input terminal.

12. The pixel circuit according to claim 11, wherein the pixel circuit comprises a sixth controlled switch unit, a first terminal of the sixth controlled switch unit is connected to the third node, a second terminal of the sixth controlled switch unit is connected to the electroluminescent module.

13. The pixel circuit according to claim 12, wherein a control terminal of the sixth controlled switch unit is connected to the fourth control signal input terminal, and the threshold voltage of the sixth controlled switch unit is consistent with that of the fifth controlled switch unit.

14. The pixel circuit according to claim 11, wherein each of the controlled switch units and the drive module is a P-type transistor.

15. The pixel circuit according to claim 8, wherein each of the controlled switch units and the drive module is a P-type transistor.

16. The pixel circuit according to claim 7, wherein each of the controlled switch units and the drive module is a P-type transistor.

17. The pixel circuit according to claim 6, wherein each of the controlled switch units and the drive module is a P-type transistor.

18. The pixel circuit according to claim 1, wherein each of the controlled switch units and the drive module is a P-type transistor.

19. A display device, comprising the pixel circuit according to claim 1.

20. A driving method for a pixel circuit, the pixel circuit comprising:

a drive module, an energy storage module, an electroluminescent module, a data voltage writing module, a threshold compensation module and a reset module, and further comprising an operating voltage input terminal, a data voltage input terminal and a plurality of control signal input terminals; wherein a first terminal of the energy storage module is connected to a first node, a second terminal of the energy storage module is connected to a second node;

a control terminal of the drive module is connected to the first node, an output terminal of the drive module is connected to a third node, the drive module is configured to generate, when a terminal of the drive module is connected to the operating voltage input terminal, a drive current for driving the electroluminescent module according to the voltage on the first node, and output the drive current to the third node;

the data voltage writing module is connected to a first control signal input terminal, the data voltage input terminal and the second node, the data voltage writing module is configured to write the data voltage applied to the data voltage input terminal to the second node in response to the control signal applied to the first control signal input terminal;

the threshold compensation module is connected to the first node and a second control signal input terminal, the threshold compensation module is configured to compensate the voltage on the first node into a sum of the threshold voltage of the drive module and the voltage applied to the operating voltage input terminal in response to the control signal applied to the second control signal input terminal;

an output terminal of the reset module is directly connected to the first node, an input terminal and a control terminal of the reset module are connected to a third control signal input terminal, the reset module is configured to be turned on when a reset pulse is applied to the third control signal input terminal, so as to reset the first node;

the driving method comprising: a reset phase, a compensation phase, a data voltage writing phase and a light emitting phase; wherein, in the reset phase, a reset pulse is applied to the third control signal input terminal, the voltage on the first node is reset to the voltage corresponding to the reset pulse;

in the compensation phase, the threshold compensation module is controlled by a control signal applied to the second control signal input terminal, so as to compensate the voltage on the first node to a sum of the threshold voltage of the drive module and the voltage applied to the operating voltage input terminal;

in the data voltage writing phase, a control signal is applied to the first control signal input terminal to turn on the data voltage writing module, so as to write the voltage on the data voltage input terminal to the second node;

in the light emitting phase, the voltage on the first node is transited by changing the voltage on the second node, so that the drive control module generates a driving current for driving the electroluminescent module to emit light.

* * * * *